US005830081A

United States Patent [19]

Kitahara

[11] Patent Number: 5,830,081

[45] Date of Patent: Nov. 3, 1998

[54] GOLF PUTTERS AND GRIPS FOR PUTTERS

[76] Inventor: Akira Kitahara, 585-4. Kamojima, Kamojimacho, Oe-gun, Tokushima, Japan

[21] Appl. No.: 774,331

[22] Filed: Dec. 27, 1996

[30] Foreign Application Priority Data

Dec. 29, 1995 [JP] Japan ..... 7-354881

[51] Int. Cl.[6] ..... A63B 53/16

[52] U.S. Cl. ..... 473/294; 473/296; 473/203

[58] Field of Search ..... 473/294, 295, 473/298, 303, 201, 203, 204, 206, 288, 293, 296, 299; 273/81.4, 81.2, 81 D, 81.3

[56] References Cited

U.S. PATENT DOCUMENTS

| | | | |
|---|---|---|---|
| 2,092,839 | 9/1937 | Gouvernear | 473/203 |
| 2,321,773 | 6/1943 | Ruemelin | 473/201 |
| 2,801,106 | 7/1957 | Koehler | 473/295 X |
| 3,376,038 | 4/1968 | Henry | 473/206 |
| 5,125,657 | 6/1992 | Beil | 473/294 X |

FOREIGN PATENT DOCUMENTS

| | | | |
|---|---|---|---|
| 5731875 | 2/1982 | Japan | 53/14 |

*Primary Examiner*—George J. Marlo
*Attorney, Agent, or Firm*—Arnold B. Silverman; Benjamin T. Queen, II; Eckert Seamans Cherin & Mellott, LLC

[57] ABSTRACT

A shaft of a golf putter has a stroke grip between a support grip and a putterhead. The stroke grip has an engaging face that is supported by the fingers of a player and a pushing face to be grasped by the palm of the player. The putter is in suspension by the support grip being supported by the other fingers of the player. When the putter is locked in suspension, the engaging face of the stroke grip is supported by the fingers of the player and the pushing face is touched by the palm of the player.

3 Claims, 8 Drawing Sheets

4
40
45
11

GOLF PUTTERS AND GRIPS FOR PUTTERS

FIELD OF THE INVENTION

The present invention relates to golf putters and grips to be attached to putters.

BACKGROUND OF THE INVENTION

FIG. 10 shows a golf putter conventionally in use. The putter comprises a shaft 1, a putterhead 2 attached to one end of the shaft and having a face 20, and a grip 3 provided on the other end of the shaft. The grip 3 is tapered toward the putterhead 2, has a minimum wall thickness, i.e., of several millimeters, needed for fitting the shaft 1 therein, and is shaped in the form of a slender rod so as to be grasped in the hand.

In a putting stance, a phantom line L through the shoulders of the player is parallel to the target direction as shown in FIG. 8, and the grip 3 of the putter is grasped by both hands to position the putterface 20 square to the target. The player then performs an upright swing in the known manner with the left shoulder lowered when the right shoulder is raised and with the right shoulder lowered when the left shoulder is raised as shown in FIG. 9, swinging the putter without altering the direction of the putterface 20 to strike the golf ball toward the target direction.

However, the conventional putter has the following problems.

It is not easy for unskilled common golfers to strike the golf ball correctly toward the target because of the difficulty encountered in directing the shoulder-to-shoulder phantom line L accurately toward the target; if the phantom line L is positioned incorrectly, the putter will be swung in a wrong direction. Furthermore, the midpoint 8 between the shoulders tends to move during putting, giving rise to other errors.

Additionally, the putterhead 2 is liable to move along a circular-arc path (see FIG. 8) as will be described later. The putterface 20 initially facing the target therefore becomes inclined during the putting stroke. This presents difficulty in striking the golf ball correctly toward the target.

FIG. 11 shows another putter 6, which comprises a shaft 1 having a greater length than usual putters and provided with a rodlike abutting grip 3*a* on the elongated shaft end. When the putter 6 is to be used, the upper abutting grip 3*a* is grasped by one hand and abutted against the breast of the player, and a lower grip 3 is grasped and moved by the other hand to swing the putter as supported at the abutting grip 3*a*. Like the conventional rod-shaped grip, however, the grip 3*a* is holdable over a wide region by grasping or placing fingers thereon, so that the support point for swinging the putter shifts greatly. The putter 6 requires skill for manipulation and is inconvenient to carry since the shaft 1 is too long to accommodate in the golf bag.

To solve this problem, the putter shown in FIGS. 12(*a*) and 12(*b*) is made available (JP-A No. 31875/1982). The illustrated putter has a support grip 4 attached to one end of a shaft 1 by swivel means 70. For putting, the support grip 4 is grasped by one hand, and the shaft 1 is gripped by the other hand and swung as supported by the swivel means 70.

However, if the shaft 1 is swung strongly toward a far target with the support grip 4 grasped, a great force acts on the swivel means 70 at the same time, entailing the likelihood that the golf ball will not be struck correctly toward the target due to wobbling or lateral deflection. The swivel means 70 is liable to become shaky when subjected to a force since it can not be supported with fingers or otherwise. The provision of the swivel means results in an increased cost.

An object of the present invention is to provide a putter which enables the player to strike the golf ball therewith easily and correctly toward the target.

SUMMARY OF THE INVENTION

The present invention provides a golf putter which comprises a shaft 1, a putterhead 2 attached to a lower end of the shaft 1 and formed on one side thereof with a face 20 for striking a golf ball, a support grip 4 attached to an upper end of the shaft 1 and provided at a bottom portion thereof with a support face 40 engageable by fingers of the player for supporting the putter in its entirety in suspension, and a stroke grip 3 attached to the shaft 1 below the support grip 4, with the shaft 1 positioned in the center of the stroke grip 3, and provided on a side portion thereof with a pushing face 30 for placing fingers or the palm of the player thereon.

According to the present invention, the support grip 4 is not intended for grasping but is to be supported by the palm or fingers.

When the putter is to be moved for a stroke, the support face 40 of the support grip 4 is supported by the fingers of one hand to suspend the putter 6. The other hand, grasping or placed on the pushing face 30 of the stroke grip 3, is moved in the target direction to rotate the putter 6, as supported at the center of the support face 40 of the support grip 4,. vertically relative to the ground like a pendulum and bring the face 20 into striking contact with the golf ball.

Since the putter 6 is thus vertically rotated as supported in suspension at the center of the support face 40 of the support grip 4, the putterhead 2 is unlikely to rotate about the body of the player unlike the conventional putter. Accordingly, the putter enables even unskilled common golfers to strike the golf ball with ease accurately toward the target.

DETAILED DESCRIPTION OF EMBODIMENTS

First Embodiment

Embodiments of the present invention will be described below with reference to the drawings concerned.

Figure 1:
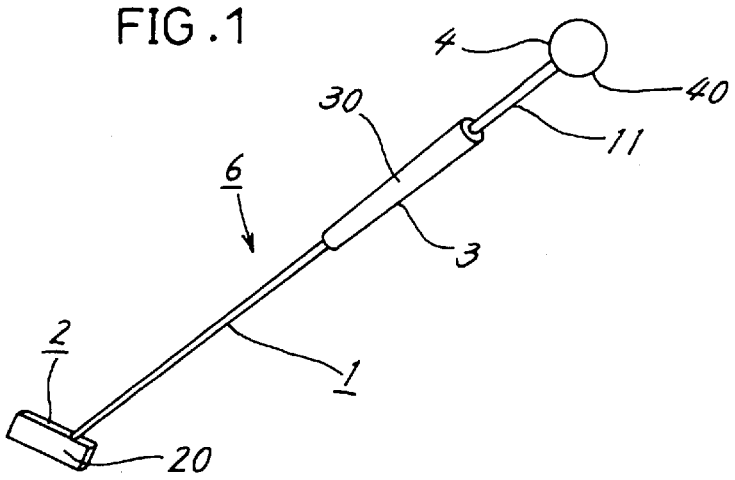
FIG. 1 is a perspective view of a putter embodying the invention.

FIG. 1 is a perspective view of a putter 6. A shaft 1 has one end provided with a putterhead 2 and the other end inserted through a stroke grip 3 by a press fit for grasping. A spherical support grip 4 is attached to a shaft portion 11 projecting from the grip 3. The stroke grip 3 has a side face serving as a pushing face 30 to be grasped or pressed by fingers and the palm of the player. The putterhead 2 is formed with a face 20 to be brought into contact with the golf ball as is well known.

The support grip 4 is formed with a support face 40 to be supported by fingers and providing a center for the rotation of the putter 6.

Figure 3A:
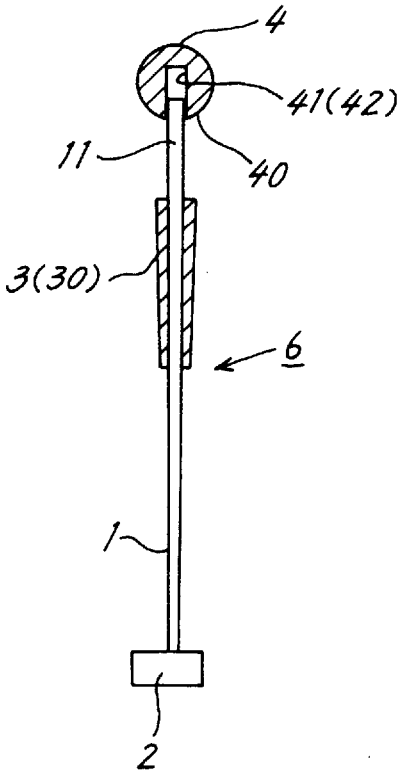
FIGS. 3(*a*) and 3(*b*) are views in vertical section of the putter, FIG. 3(*a*) showing the putter wherein a clearance is formed between one end of a shaft and the bottom of a bore in a support grip, FIG. 3(*b*) showing the putter with the shaft end in intimate contact with the bottom of the bore.
Figure 3B:
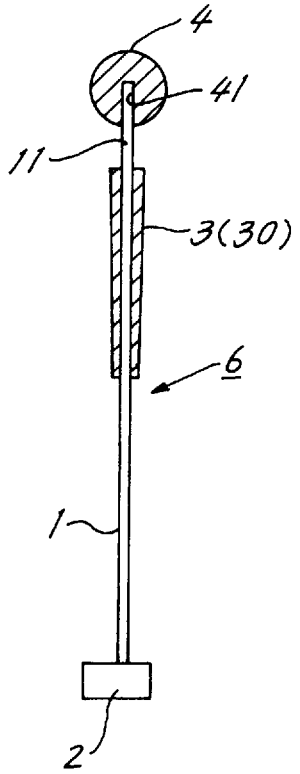

With reference to FIG. 3(a), a bore 41 having a lower open end is formed in the support grip 4, and the extremity of the projecting portion 11 of the shaft 1 is inserted in the bore 41 by a press fit. A clearance 42 is formed between the bottom face of the bore 41 and the top end face of the shaft 1, and the portion of the shaft 1 fitted in the support grip 4 is adjustable. The length of the putter from the support face 40 of the grip 4 to the face 20 of the putterhead 2 is adjustable in conformity with the height of the player by varying the length of the fitted portion. The top end of the shaft 1 may be in contact with the bottom face of the bore 41 as seen in FIG. 3(*b*).

Figure 2A:
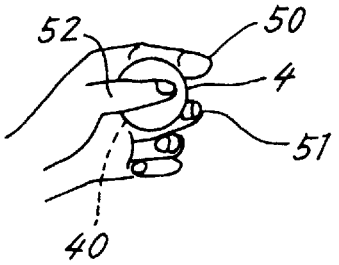
FIGS. 2(*a*) and 2(*b*) are a plan view and a front view, respectively, showing the putter as supported by hand.
Figure 2B:
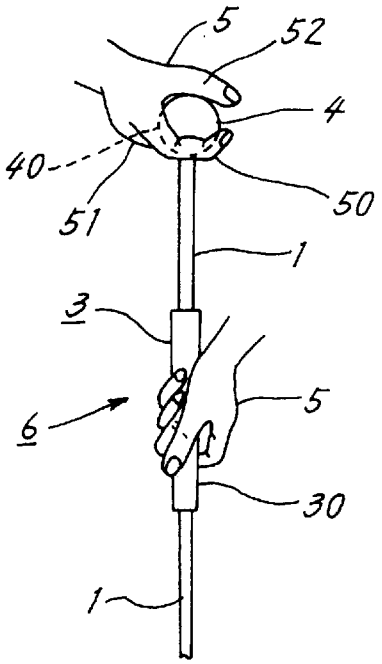

FIGS. 2(*a*) and 2(*b*) are views showing the putter 6 in use. FIG. 2(*a*) is a plan view of the support grip 4. The index finger 50 and the middle finger 51 of the hand 5 are placed beneath the support face 40 of the grip 4 with the shaft 1 held between these fingers and with the thumb 52 placed on the upper face of the grip 4. The putter 6 becomes supportable in suspension by placing the three fingers in contact with the support grip 4.

For putting, the putter 6 is suspended by supporting the support grip 4 with the three fingers of one hand, and the pushing face 30 of the grip 3 is grasped by the other hand as shown in FIG. 2(*b*) which is a front view of FIG. 2(*a*). The putter 6 is suspended at such a level that the face 20 can be brought into contact with the golf ball, with the face 20 facing the target. The hand grasping the grip 3 is moved toward the target, vertically rotating the putter 6 with the center of the support face 40 of the grip 4 serving as a support point to strike the face 20 against the golf ball.

In this way, the putter 6 can be vertically rotated accurately in a vertical plane parallel to the target direction, with the center of the support face 40 of the support grip 4 serving as a support point. Since the putter 6 rotates in suspension about the center of the support face 40 of the grip 4, the putterhead 2 need not be vertically rotated about the midpoint between the shoulders of the player unlike the conventional putter. Accordingly the putter of the invention enables even common golfers to strike the ball easily and accurately toward the target.

Figures 4A, 4B, 4C, 4D, 4E, 4F, 4G, 4H, 4I, 4J, 4K:
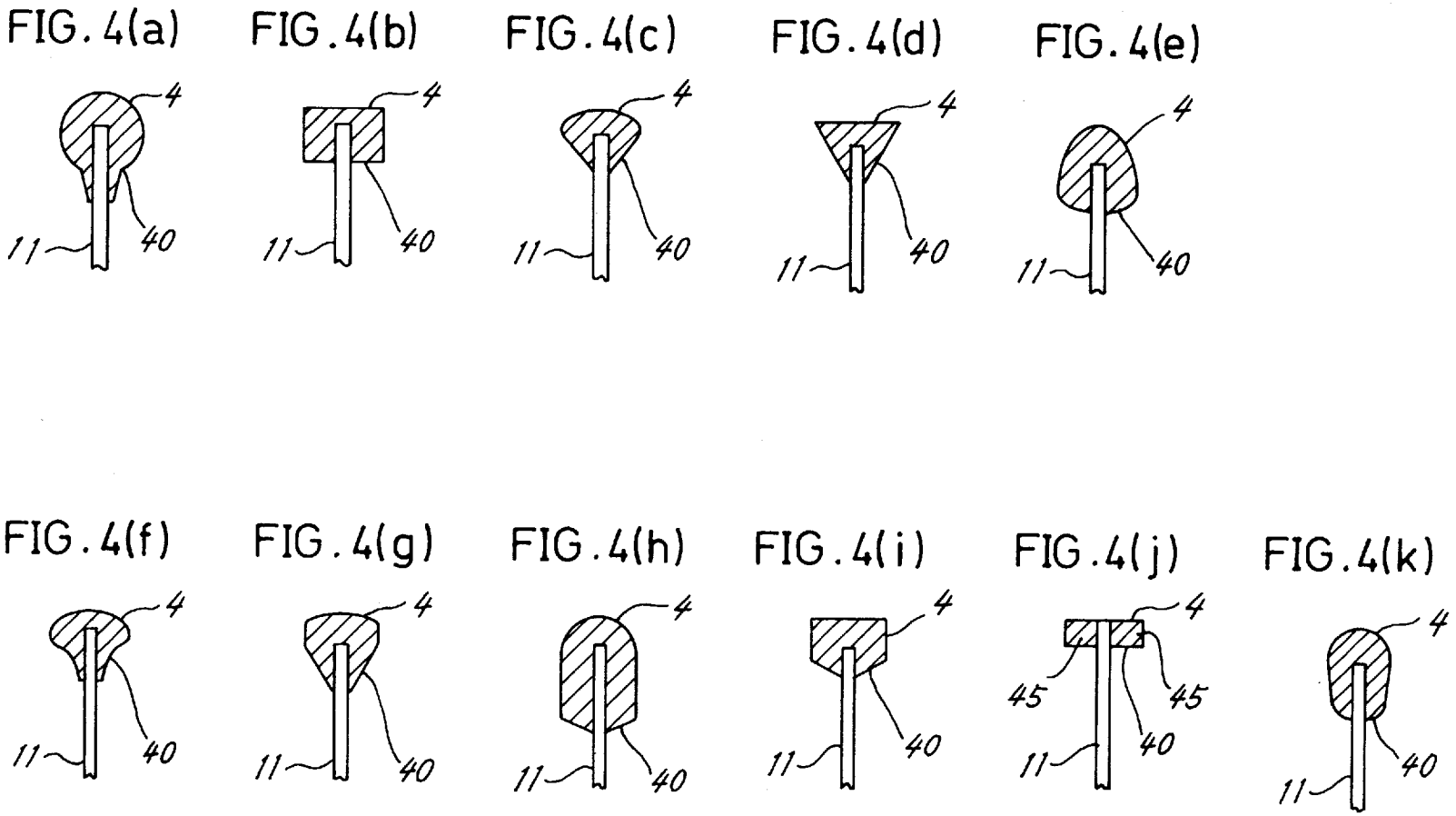
FIGS. 4(*a*) to 4(*k*) are views in vertical section showing various shapes of support grips.

The fingers to be placed on the support grip 4 are not limited to the middle finger 51, index finger 50 and thumb 52 mentioned. The support face 40 of the grip 4 may be supported, for example, by the middle finger 51 and the third finger with the shaft 1 held therebetween or by the five fingers with the palm up. The support grip 4, which is spherical, can be shaped otherwise variously as shown in FIGS. 4(*a*) to 4(*k*). Among these alterations, the support grip 4 shown in FIG. 4(*j*) comprises a pair of support pieces 45, 45 symmetrically projecting from opposite sides of the projecting portion 11 of the shaft 1 in a plane parallel to the face 20.

Figures 7A, 7B, 7C, 7D, 7E:
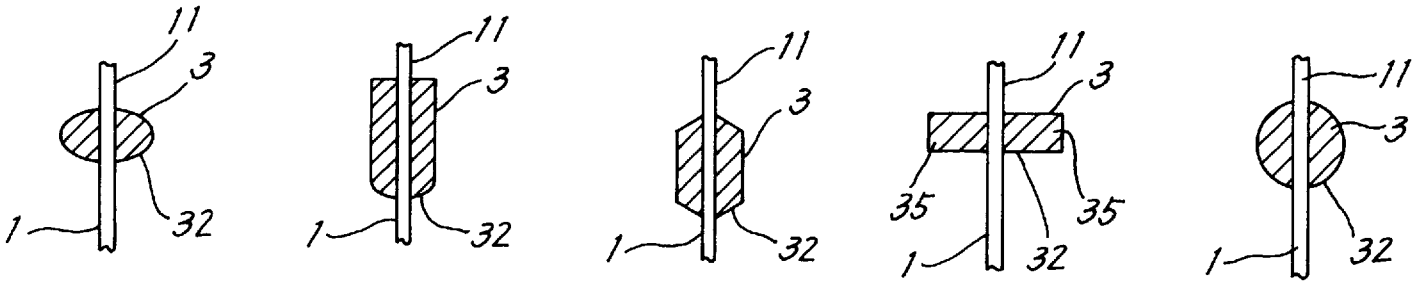
FIGS. 7(*a*) to 7(*e*) are views in vertical section showing various shapes of stroke grips.

Furthermore, the stroke grip 3 can also be altered variously in shape as shown in FIGS. 7(*a*) to 7(*e*), among which FIG. 7(*d*) shows a stroke grip 3 comprising pushing pieces 35, 35 symmetrically projecting from opposite sides of the shaft 1 in a plane parallel to the face 20. Although not shown, the support and stroke grips are, for example, circular, elliptical or polygonal in cross section.

Second Embodiment

Figure 5:
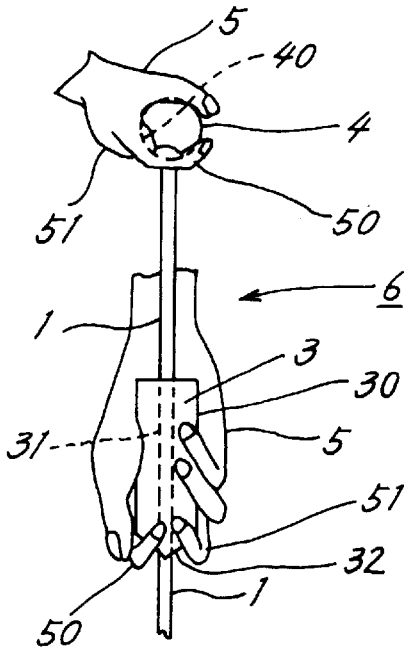
FIG. 5 is a view showing another putter embodying the invention and as supported by both hands.

The putter of this embodiment can be supported in suspension with fingers placed on the bottom face of a stroke grip 3. Stated more specifically with reference to FIG. 5, two grips 4, 3 spaced apart from each other are fitted around upper portions of a shaft 1. The stroke grip 3 is tubular and formed with a through bore 31 in its center for the shaft 1 to extend therethrough. The stroke grip 3 has a lower side providing an engaging face 32 with which fingers are engageable. The engaging face 32 is supported by the index finger 50 and the middle finger 51 with the shaft 1 held therebetween. The engaging face 32 of the stroke grip 3 is tapered generally downwardly for engagement by the fingers of the player.

Figure 6:
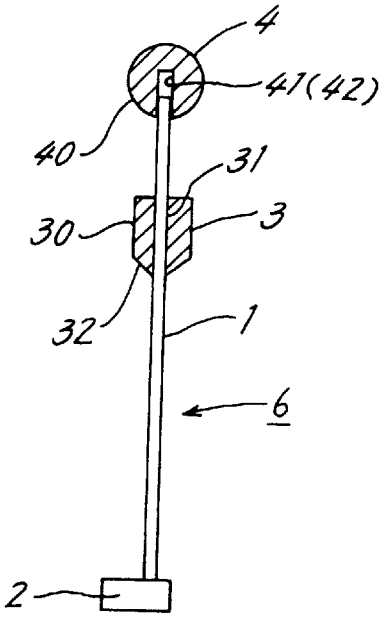
FIG. 6 is a view in vertical section showing the putter of FIG. 5.

The upper and lower grips 4, 3 are each supported by the index finger 50 and the middle finger 51, and the lower stroke grip 3 is then rotated, with the putter supported at the support face 40 of the support grip 4, whereby the golf ball can be struck easily and correctly toward the target as in the foregoing case. The top end of the shaft 1 is fitted in a bore 41 formed in the bottom of the upper support grip 4, and the shaft portion fitted in the support grip 4 is adjustable as shown in FIG. 6.

Advantages of the Embodiments

If the grip 3 of the conventional putter is grasped by both hands, the putterhead 2 is likely to rotate along a circular-arc path. The putters 3 according to the first and second embodiments are free of such likelihood as will be described in detail below.

Figure 8:
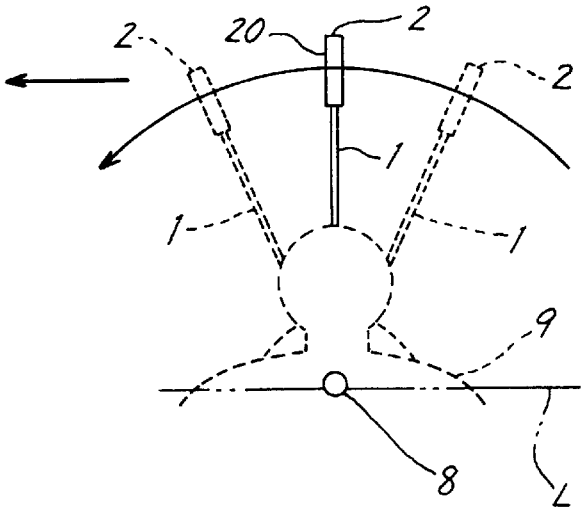
FIG. 8 PRIOR ART
FIG. 8 is a plan view showing a player swinging a putter.

FIG. 8 is a plan view showing a player 9 gripping the putter 6 by both hands. The putterhead 2 is positioned to the front of the phantom line L through the shoulders of the player 9, so that the putter 6 tends to rotate about an axis 8 in a horizontal plane if swung simply by both hands. Consequently, the putterhead 2 moves along a circular-arc path centered about the axis 8, permitting the face 20 to alter in direction and causing the golf ball struck by the putterhead 2 to turn aside from the target direction.

Figure 9:
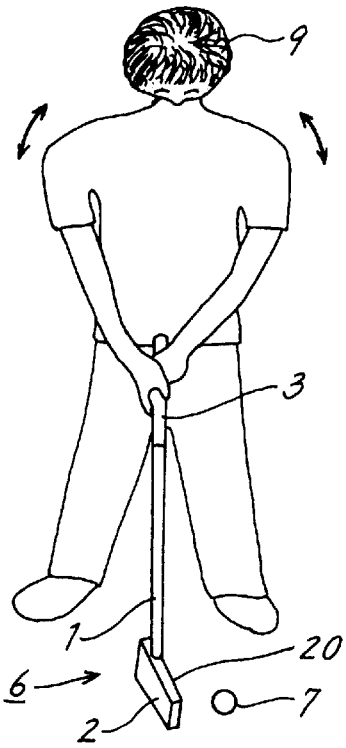
FIG. 9 PRIOR ART
FIG. 9 is a diagram showing upright rotation of the shoulders of the player.
Figure 10:
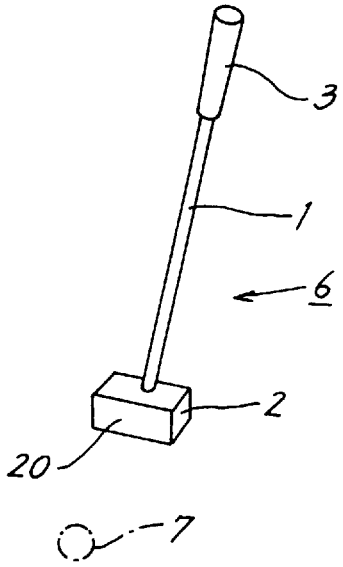
FIG.10 PRIOR ART
FIG. 10 is a perspective view showing a conventional putter.
Figure 11:
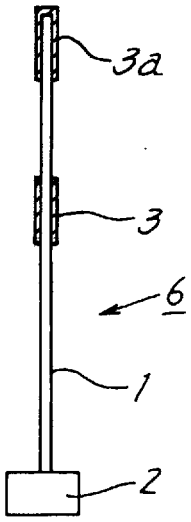
FIG.11 PRIOR ART
FIG. 11 is a view in vertical section showing another conventional putter.
Figure 12A:
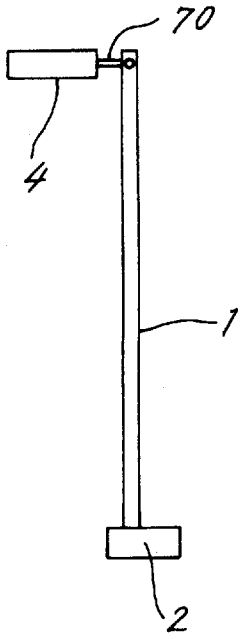
FIG. 12(a) PRIOR ART
FIGS. 12(*a*) and 12(*b*) are front views showing another conventional putter.
Figure 12B:
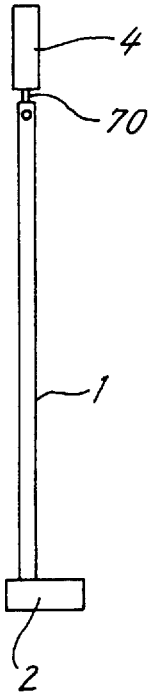
FIG. 12(b) PRIOR ART

Further in swinging the putter 6, the rotation of the waist in a horizontal plane also causes the golf ball to advance along a curved path. The faults involved in the above problems occur during the vertical rotation of the shoulders shown in FIG. 9 and conventionally experienced.

The putter of the invention pivotally moves like a pendulum in a vertical plane containing the target direction as supported in suspension by fingers at the center of the support face 20 of the support grip 4, so that the rotation of the shoulders is unnecessary for strokes. This eliminates the likelihood of the putterhead 2 moving along a circular-arc path in a horizontal plane. The movement of the putter has no bearing on the parallelism between the phantom line L through the shoulders and the target direction, and does not involve sway of the midpoint between the shoulders. Accordingly, the player can correctly strike the golf ball by the single hand only while addressing the ball with the highest stability and is therefore able to focus his attention to the control of the putting force without becoming conscious of unnecessary things to diminish errors and improve his score.

Since the support grip 4 is attached to the shaft 1 with the shaft projecting portion 11 fitted in the bore 41, the support grip 4 only is replaceable by other support grip 4. The support grip 4 is attached to the shaft 1 by fitting the grip 4 around the projecting portion 11 having a double-faced adhesive tape (not shown) affixed thereto before fitting, and pressing the grip 4 from outside. The stroke grip 3 is fitted to the shaft 1 by winding a double-faced adhesive tape around the shaft 1, pushing the grip 3 onto the shaft 1 from its upper end and pressing the grip 3 from outside. One's favorite putter 6 can be modified into a putter 6 of the invention by removing the grip from the putter 6 and attaching the stroke grip 3 and support grip 4 of the invention to the putter shaft.

Additionally the support grip 4 has a projecting portion with a double-faced adhesive tape instead of the bore 41 and being injected into the hollow of the shaft.

What is claimed is:

1. A golf putter comprising:

a shaft, a putterhead attached to a lower end of the shaft, a support grip fixed to an upper end of the shaft, said support grip including a bottom portion having a support face engageable by fingers of the player for supporting the putter, a stroke grip attached to the shaft below the support grip, said stroke grip having an elongated body including a side portion having a pushing face for placing the palm of the player thereon, and the stroke grip provided at a bottom portion thereof with an engaging face engageable by fingers of the player.

2. A golf putter as defined in claim 1 wherein the support face of the support grip is formed with a bore having a bottom, and the upper end of the shaft is tightly fitted in the bore of the support grip to a predetermined depth, the distance between the putterhead and the support face of the support grip being adjustable by varying the depth of the fitted shaft portion.

3. The golf putter as defined in claim 2 wherein said engaging face of the stroke grip is tapered generally downwardly for engagement by the fingers of the player.

* * * * *